United States Patent [19]

Hudson

[11] Patent Number: 4,506,991

[45] Date of Patent: Mar. 26, 1985

[54] ADJUSTABLE ORIFICE FOR EMULSIFIER

[76] Inventor: Dannie B. Hudson, 741 Mayflower Dr., Red Bank, N.J. 07701

[21] Appl. No.: 386,193

[22] Filed: Jun. 7, 1982

[51] Int. Cl.[3] ..... B01F 5/06

[52] U.S. Cl. ..... 366/341; 366/336; 138/45; 251/212

[58] Field of Search ..... 366/336, 337, 339, 340, 366/176, 341; 138/45; 251/212

[56] References Cited

U.S. PATENT DOCUMENTS

| | | | |
|---|---|---|---|
| 992,027 | 5/1911 | Morlock | 251/212 |
| 1,095,767 | 5/1914 | Adams | 138/45 X |
| 1,835,891 | 12/1931 | Mildren | 251/212 |
| 1,925,787 | 9/1933 | Brooks . | |
| 1,986,600 | 1/1935 | Pigott | 138/45 |
| 2,321,336 | 6/1943 | Tondreau . | |
| 2,424,654 | 7/1947 | Gamble | 138/45 X |
| 2,552,192 | 5/1951 | Lopata . | |
| 2,628,204 | 2/1953 | Gray . | |
| 2,740,426 | 4/1956 | Dorfan | 138/45 |
| 2,968,919 | 1/1961 | Hughes et al. | 138/45 X |
| 3,106,225 | 10/1963 | Spurling . | |
| 3,409,050 | 11/1968 | Weese . | |
| 3,473,781 | 10/1969 | Abbott et al. . | |
| 3,724,503 | 4/1973 | Cooke | 138/45 |
| 4,081,863 | 3/1978 | Rees | 366/176 |
| 4,085,463 | 4/1978 | Wilson . | |
| 4,127,332 | 11/1978 | Thiruvengadam et al. . | |
| 4,191,216 | 3/1980 | Connolly . | |
| 4,213,711 | 7/1980 | Baily . | |

FOREIGN PATENT DOCUMENTS

| | | | |
|---|---|---|---|
| 630 | of 1888 | United Kingdom | 251/212 |

*Primary Examiner*—Philip R. Coe
*Assistant Examiner*—Frankie L. Stinson
*Attorney, Agent, or Firm*—Lerner, David, Littenberg, Krumholz & Mentlik

[57] ABSTRACT

An adjustable orifice assembly adapted for use in a homogenization apparatus for intermixing a multicomponent stream includes a pair of opposed orifice defining elements removably secured to a control assembly to provide a variable orifice in effecting the homogenization of the stream.

21 Claims, 11 Drawing Figures

ADJUSTABLE ORIFICE FOR EMULSIFIER

BACKGROUND OF THE INVENTION

The present invention relates in general to an adjustable orifice for emulsifier and, more particularly, to an adjustable orifice assembly adapted for use in an apparatus for homogenization of a stream of a liquid component and a substantially insoluble component which may be either a liquid or a finely divided solid by the use of cavitating flow.

In accordance with U.S. Pat. No. 4,127,332, there is disclosed a homogenization apparatus which provides an emulsion or colloidal suspension having an extremely long separation half-life by the use of cavitating flow. The prior art homogenization apparatus is constructed of a generally cylindrical conduit including an orifice plate assembly extending transversely thereacross and having an orifice opening provided therein. The orifice opening is described as embodying various designs such as circular blunt or sharp edged, square sharp edged and, a pair of substantially semi-circular annular segments. The homogenization process is effected by passing a multicomponent stream, including a liquid and at least one insoluble component, into a cavitating free turbulent velocity shear layer created by the orifice opening through which the stream flows with a high velocity. The cavitating free turbulent shear layer provides a flow regime in which vapor bubbles form, expand, contract and ultimately collapse. By subsequently exposing the free turbulent shear layer to a sufficient high downstream pressure, the bubbles collapse violently and cause extremely high pressure shocks which cause intermittent intermixing of the multicomponent stream. As a result, a homogenized effluent of liquid and the insoluble component is generated which has a substantially improved separation half-life.

In accordance with the prior art homogenization apparatus, it is generally known that the effective intermixing of the multicomponent stream is dependent upon a number of factors, for example, upstream pressure, downstream pressure, conduit diameter, orifice diameter, etc. The most critical factor is generally considered to be the orifice diameter, which factor is often the most difficult to control effectively over the continued use of the homogenization apparatus. Specifically, upon heating of the orifice plate assembly, the resulting expansion causes variation in the orifice diameter thereby adversely effecting the homogenization process. Further, erosion of the orifice plate assembly at the orifice opening due to chemical or mechanical action caused by the insoluble particles within the multicomponent stream, causes the orifice diameter to increase during the homogenization process also resulting in a change in the effectiveness of the intermixing of the multicomponent stream. Still further, it is generally required that the orifice diameter be determined for each different homogenization process, which determination is generally extensive in labor, in addition, to requiring system shutdown during installation of a different orifice plate assembly.

Thus, it can be appreciated that there is an unsolved need for an orifice plate assembly adapted for use in a homogenization apparatus which provides for the effective intermixing of a multicomponent stream in a potentially corrosive environment over a variety of operating conditions in an economical and effective manner.

SUMMARY OF THE INVENTION

It is broadly an object of the present invention to provide an adjustable orifice assembly for use in a homogenization apparatus which overcomes or avoids one or more of the foregoing disadvantages resulting from the use of the above-mentioned prior art orifice plate assembly and, which fulfills the requirements of such an orifice plate assembly for use in a homogenization apparatus for the intermixing of a multi-component stream. Specifically, it is within the contemplation of one aspect of the present invention to provide an adjustable orifice assembly adapted to have replaceable orifice defining elements and which are adjustable over a range of operating conditions for accomodating various process parameters encountered during the use of a homogenization apparatus in the manner previously described.

A further object of the present invention is to provide an adjustable orifice assembly adapted for use in a homogenization apparatus for homogenizing a liquid and a substantially insoluble component by generating a cavitating flow regime in a turbulent velocity shear layer.

A still further object of the present invention is to provide an adjustable orifice assembly adapted for use in a homogenization apparatus for homogenizing a multi-component stream to produce an intermixing of a dispersed component and a continuous component.

A still further object of the present invention is to provide an adjustable orifice assembly adapted for use in a homogenization apparatus over a variety of operating conditions.

A yet still further object of the present invention is to provide an adjustable orifice assembly adapted for providing a controlled orifice diameter in an inexpensive and readily adjustable manner.

The above, and many other objects of the present invention, are satisfied by an adjustable orifice assembly in accordance with one embodiment of the present invention adapted for use in an apparatus for homogenizing a liquid component and an insoluble component comprising, a pair of orifice defining means for defining an orifice therebetween within a stream of the liquid component, and adjusting means in operative association with the orifice defining means for adjusting the size of the orifice for effecting the homogenization of the liquid component and a stream of the insoluble component.

In accordance with the above embodiment, the adjustable orifice assembly includes a pair of orifice defining elements removably secured to the adjusting means and arranged in opposed relationship for defining an orifice therebetween.

In accordance with another embodiment of the present invention there is provided an adjustable orifice assembly adapted for use in an apparatus for homogenizing a liquid component and an insoluble component comprising, impeding means for impeding the flow of a stream of a liquid component, the impeding means having an opening provided therein, orifice defining means movably positioned within the opening for defining an orifice through which the stream of the liquid component flows and controlling means for controllng the position of the orifice defining means within the opening such that the size of the orifice is adjustable for effecting the homogenization of the liquid component and the insoluble component.

In accordance with the last mentioned embodiment, the impeding means comprises a body having a pair of opposed radially extending threaded passageways communcating between the opening and the periphery of the body and, the control means comprises a longitudinally extending rod having a threaded portion adapted to be adjustably received within the threaded portion of the passageway and having one end adapted to removably secure the orifice defining means thereto.

Further in accordance with the last mentioned embodiment, the opening is provided by forming means removably secured within the impeding means for forming the opening to receive the orifice defining means therein.

BRIEF DESCRIPTION OF THE DRAWINGS

The above description, as well as further objects, features and advantages of the present invention will be more fully understood by reference to the following detailed description of a presently preferred, but nonetheless illustrative, adjustable orifice assembly in accordance with the present invention when taken in conjunction with the accompanying drawings, wherein.

DETAILED DESCRIPTION

Figure 2:
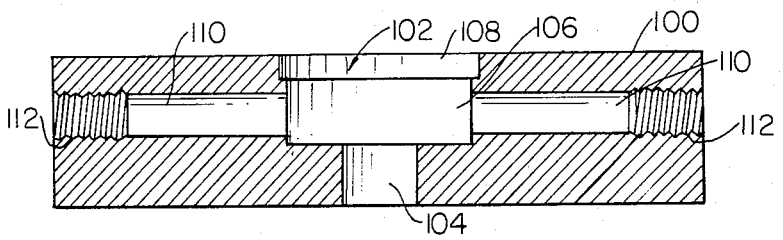
FIG. 2 is a cross-sectional elevation taken along line 2—2 of FIG. 1 illustrating the body including a pair of opposed radially extending threaded passageways communicating between the opening and the periphery of the body.
Figure 1:
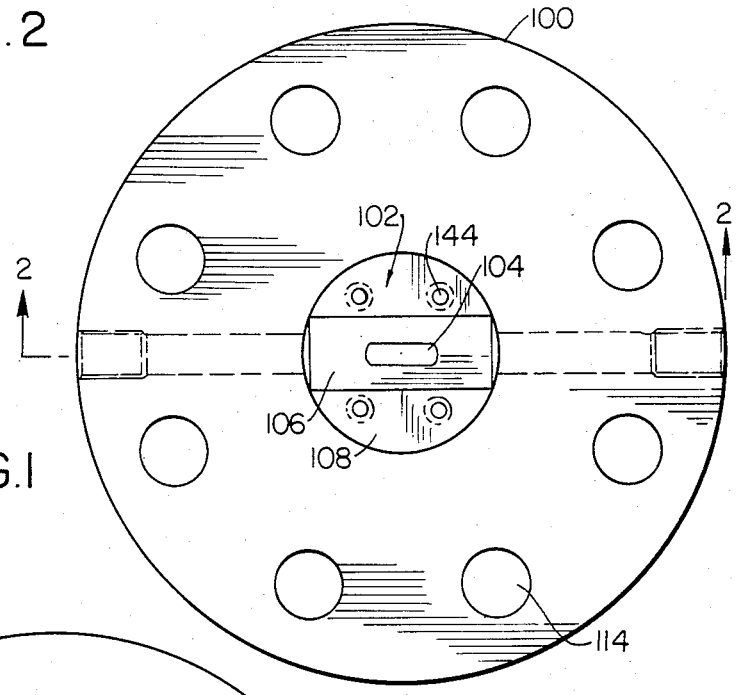
FIG. 1 is a front elevation illustrating the adjustable orifice assembly constructed of a body having a central opening provided therein.
Figure 3:
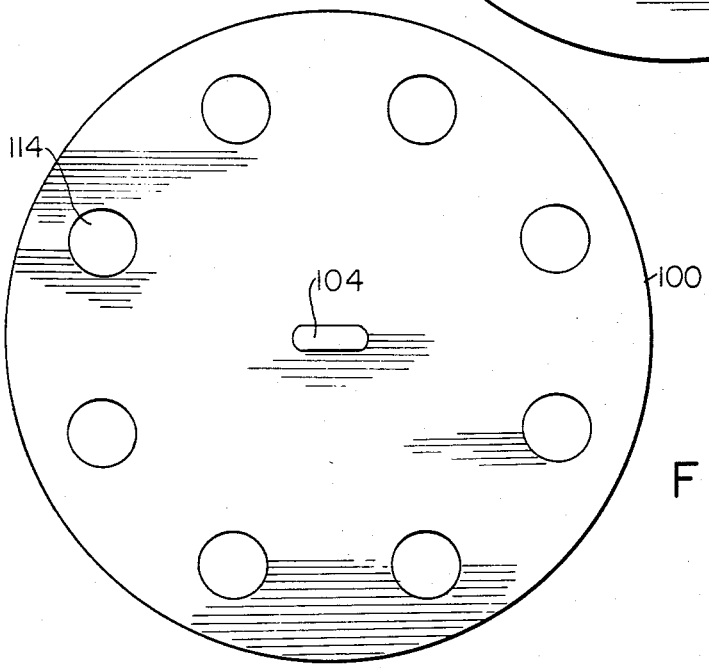
FIG. 3 is a rear elevation of the body as illustrated in FIG. 1.

Referring generally to the drawings wherein like reference numerals are applied to like elements, there is shown in FIGS. 1 through 3 a generally planar body 100 of circular shape having a central opening 102 provided therein. The central opening 102 is formed of a bottom slotted opening 104, a rectangular central opening 106 and a top disk shaped opening 108. The body 100 is further constructed to include a pair of opposed radially extending passageways 110 communicating between the rectangular central opening 106 and the periphery of the body. The peripheral mouth of the passageways 110 are provided with internal threads 112 extending partially therein. Located around the circumference of the body 100 are a plurality of installation holes 114 to be described hereinafter.

Figure 4:
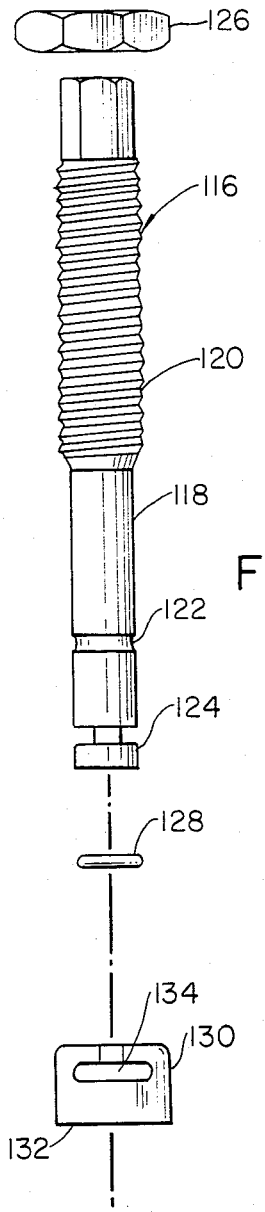
FIG. 4 is a side elevation of the control means arranged in unassembled relationship including a longitudinally extending rod, securing nut, O-ring gasket and a removable orifice defining element.
Figure 5:
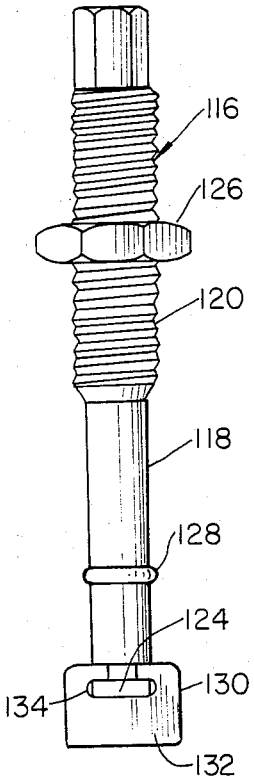
FIG. 5 is a side elevation of the controlling means as illustrated in FIG. 4 in assembled relationship.

Referring now to FIG. 4, there is illustrated in unassembled relationship an orifice control assembly generally designated by reference numeral 116 and, in assembled relationship in FIG. 5. The control assembly 116 is constructed from a longitudinally extending rod 118 having a threaded portion 120, a circumferential groove 122 and a T-shaped projection 124. In addition, the control assembly 116 includes a nut 126 adapted to be received about the threaded portion 120 of the rod 118, an O-ring gasket adapted to be received within the groove 122 to circumscribe the rod 118 and, an orifice defining element 130 having a generally planar face 132 adapted to be removably secured to the projection 124 of the rod 118 by sliding engagement within a T-shaped slot 134 provided therein.

Figure 7:
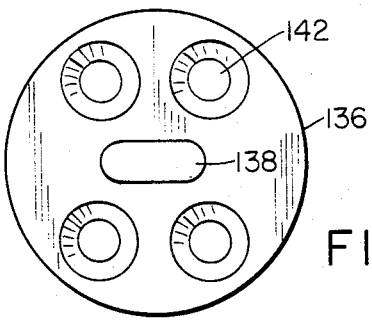
FIG. 7 is a front elevation of a cover having a slotted opening and adapted to be received within an opening provided within the body as illustrated in FIG. 1.
Figures 6, 8:
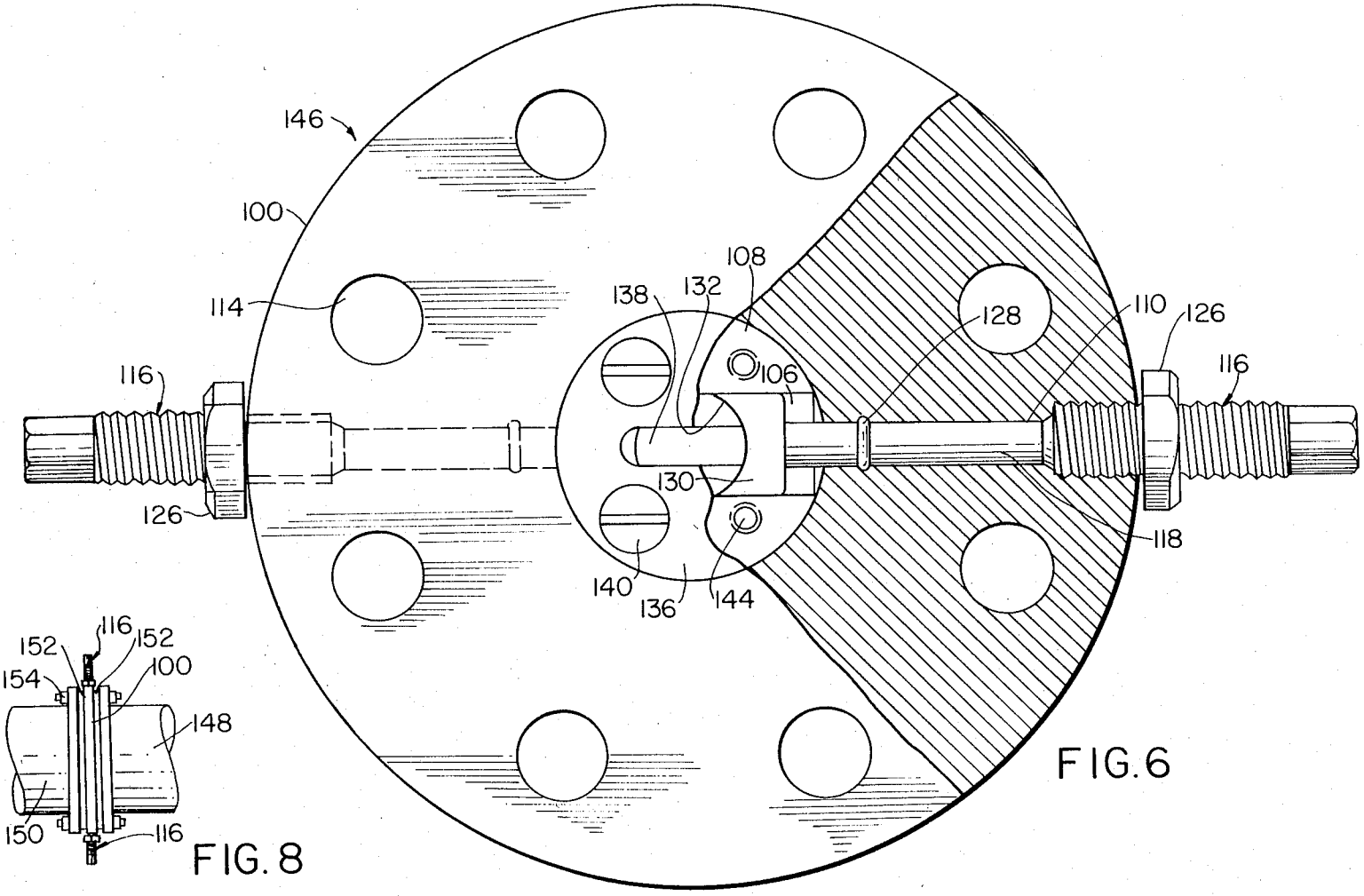
FIG. 6 is a front elevation having a planar section removed for illustrating the control means in assembled relationship threadably engaged within the passageways and having a pair of orifice defining elements arranged within the opening of the body to define an adjustable orifice therebetween.
FIG. 8 is a side elevation of the adjustable orifice assembly in accordance with either embodiment of the present invention secured between two flanges of a pipe adapted to receive the multicomponent stream to be homogenized.

Referring to FIG. 6, there will now be described the positioning of the control assembly 116 within the body 100 and its subsequent operation in effecting homogenization of a multicomponent stream. Specifically, a control assembly 116 having the O-ring 128 provided within the groove 122 and the orifice defining element 130 removed from engagement with the projection 124, is threadably inserted within each passageway 110 until its projection enters the rectangular central opening 106 of the body 100. The nut 126 is engaged about the threaded portion 120 of the rod 118 for initially securing the rod within the passageway 110 at a desired position. A pair of orifice defining elements 130 are positioned within the rectangular central opening 106 of the body 100 and are removably secured to a projection 124 of each rod 118 via the T-shaped slot 134 provided therein. A cover 136, as shown in FIG. 7, is adapted to be received within the disk shaped opening 108 overlying the orifice defining elements 130 and having a slotted opening 138 in alignment with the slotted opening 104 within the body 100. The cover 136 is secured within the disk shaped opening 108 by a plurality of bolts 140 arranged within the bolt holes 142 and securely received within the threaded openings 144 within the body 100. The adjustable orifice assembly, generally designated by reference numeral 146, is now fully assembled.

The adjustable orifice assembly 146, as shown in FIG. 8, is secured for use between a pair of flanges of an upstream pipe 148 and a downstream pipe 150 using a pair of gaskets 152 and a plurality of circumferentially arranged bolts 154 within the holes 114 of the body 100. The size of the orifice through which a stream of liquid may flow from the downstream pipe 150 to the uptstream pipe 148 through the adjustable orifice assembly 146 may be controlled by adjusting the spaced relationship between the orifice defining elements 130 within the rectangular central opening 106 via the control assembly 116. That is, by turning the rods 118 within the passageways 110, the faces 132 of the orifice defining elements 130 are brought into closer or further spaced relationship so as to cause adjustment in the size of the orifice provided therebetween. During such adjustment, the O-ring 128 provides a liquid seal between the rod 118 and the passageway 110. Although the face 132 of the orifice defining element 130, as shown in FIG. 4, has been described and illustrated as being transversely planar, it is readily apparent that other shapes of such face may be provided in accordance with the present invention. Specifically, as illustrated in FIG. 6, the face 132 is provided as a concave section.

The specific application of the adjustable orifice assembly 146 in effecting the homogenization of a liquid component and an insoluble component using cavitating flow is in general accordance with the previously noted U.S. Pat. No. 4,127,332 and accordingly will not be described in detail. For example, suitable liquid components are water, hydrocarbon fuels, and the like; while, suitable insoluble component are liquids as such water, hydrocarbon fuels, particulate solids such as pulverized coal, and the like. Where the liquid component is water and the substantially insoluble component is hydrocarbon fuel, or in the alternative, where water is the substantially insoluble component and hydrocarbon fuel is the liquid component, the homogenized effluent is a fluid emulsion which may subsequently be used as a fuel such as for the burner of a boiler. With such a boiler, the fuel might consist of a fuel/water emulsion, a coal/oil colloidal suspension or an oil/oil emulsion. However, it is noted that the insoluble component may be introduced into the liquid component either at the upstream or downstream side of the adjustable orifice assembly 146.

In accordance with a specific embodiment of the present invention, the adjustable orifice assembly 146 is used for homogenizing a mixture of oil, such as a hydrocarbon fuel and water for providing a steady supply of fuel to the burner of a boiler. In this regard, the oil is continuously supplied through the upstream pipe 150 at a pressure of about 300 psig. The slotted opening 104 of the body 100 and slotted opening 138 of the cover 136 are approximately one-quarter of an inch by three-quarters of an inch in size. The orifice defining elements 130 are arranged in opposed relationship within the rectangular central opening 106 approximately one quarter of an inch apart thereby providing an orifice through which the oil flows. As a result of such construction, the pressure within the downstream pipe 148 is approximately 40 psig. The water may be introduced as previously noted either in the downstream pipe 148 adjacent the adjustable orifice assembly 146 or within the upstream pipe 150 to effect homogenization thereof. The adjustable orifice plate assembly 146 may be fine tuned for optimum homogenization by adjusting one or both of the control assemblies 116 in the manner previously described to effect the spaced relationship between the faces 132 of the orifice defining elements 130.

In accordance with one object of the present invention, should the orifice defining elements 130 errode severely or become damaged during use, such elements may be easily and quickly replaced upon removing the cover 136. As further noted, the minor erosion of the orifice defining elements 130 may be further compensated for by adjusting the control assemblies 116 so as to lessen the spaced relationship therebetween caused by the erosion. In this regard, in the preferred embodiment, the orifice defining elements 130 are constructed of nitriding steel No. 135, modified. Still further in accordance with other objects of the present invention, the adjustable orifice assembly 146 is readily adaptable to various process conditions in which various orifice sizes are required by the simple adjustment of the control assemblies 116 in the manner already described. Thus, it can be appreciated that the adjustble orifice assembly 146 of the present invention has superior advantages to the fixed diameter orifice of the prior art and overcomes the above noted problems in association with such prior art orifice plate assembly.

Figure 10:
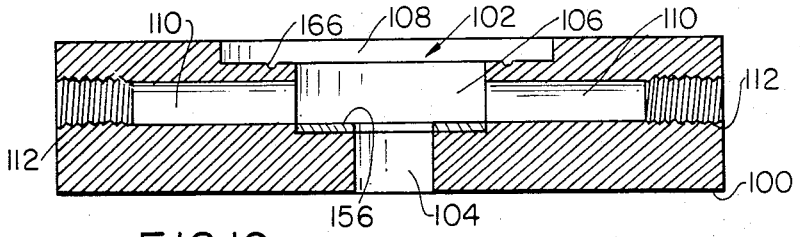
FIG. 10 is a cross-sectional elevation taken along line 9—9 of FIG. 8 illustrating the body in accordance with the other embodiment of the present invention and showing a circular groove to retain an O-ring gasket thereat.
Figure 9:
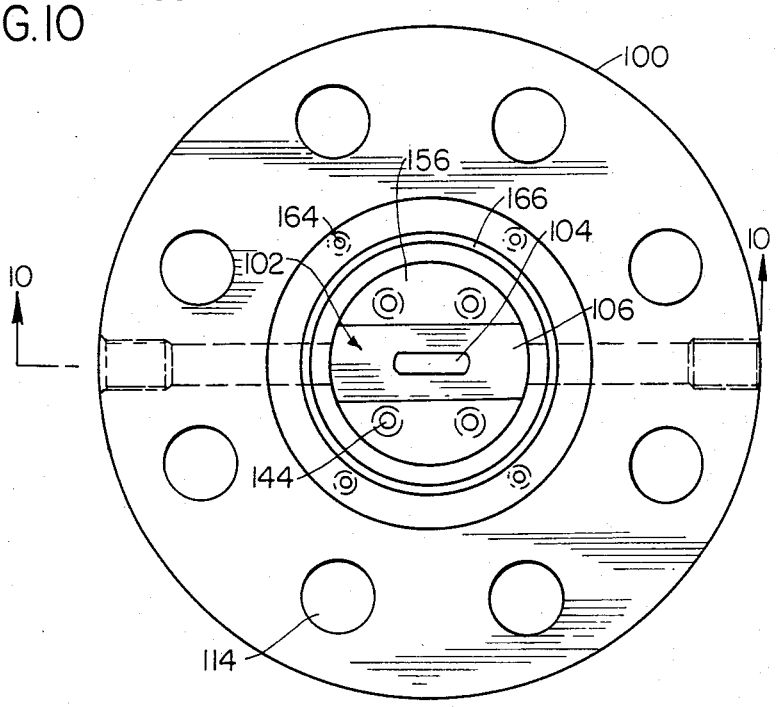
FIG. 9 is a front elevation illustrating the adjustable orifice assembly in accordance with another embodiment of the present invention showing forming means removably secured within the body for forming an opening to receive the orifice defining elements.
Figure 11:
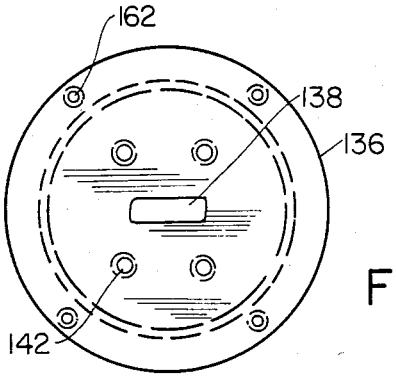
FIG. 11 is a front elevation of a cover in accordance with the other embodiment of the present invention adapted to be received within an opening provided within the body as illustrated in FIG. 9.

Referring to FIGS. 9 through 11, there is illustrated an adjustable orifice assembly constructed in accordance with another embodiment of the present invention. As the body 100 is similarly constructed and arranged in general accordance with the embodiment illustrated in FIGS. 1 and 2, only the differences between such embodiments will be described in detail hereat. In this regard, the body 100 includes a central opening 102, a slotted opening 104, a rectangular central opening 106 a disk shaped opening 108 and, radially extending passageways 110 having threaded openings 112. As shown in FIG. 9, the rectangular central opening 106 is provided within a removable insert 156 of cylindrical shape secured within the central opening 102. The size of the rectangular central opening 106 therein can therefore be easily controlled, in addition to facilitating replacement thereof, if required, due to use or damage of the insert 156.

The insert 156 is secured within the central opening 102 by the cover 136 via a plurality of bolts extending through the bolt holes 142 and into the threaded openings 144 within the insert. The cover 136, as shown in FIG. 11, includes a plurality of bolt holes 162 adapted to receive bolts for securing the cover to the body 100 within the disk shaped opening 108 overlying the insert 156 via the threaded openings 164. In this regard, the insert 156 is now secured within the central opening 102 to the cover 136 and the cover is secured to the body 100. The cover 136 is further sealingly secured to the body 100 within the disk shaped opening 108 by an O-ring gasket (not shown) provided within the circumscribing groove 166. The incorporation of the control assembly 116 within the passageways 110 and the operation of the adjustable orifice assembly in accordance with the embodiment illustrated in FIGS. 9 through 11 is as already described with respect to the embodiment illustrated in FIG. 6 and will accordingly not be repeated.

In accordance with the embodiments of the present invention, there has been described and illustrated an adjustable orifice assembly adapted for use in an apparatus for homogenizing a liquid component and an insoluble component comprising, a body adapted to be positioned within a stream of the liquid component for impeding the flow thereof, the body having an opening and a pair of radially extending passageways in communication with the opening, a pair of elements movably positioned in opposed relationship within the opening for defining an orifice between their relative spaced positions through which the stream of the liquid component flows, and a pair of rods positioned within the radially extending passageways and having the elements secured to one end thereof within the opening, whereby the size of the orifice is adjustable over an operative range for effecting the homogenization of the liquid component and the insoluble component by controlling the movement of at least one of the rods within the passageway to effect the relative position between the elements within the opening.

Although the invention herein has been described with reference to particular embodiments, it is to be understood that these embodiments are merely illustrative of the principles and application of the present invention. It is to be understood that numerous modifications may be made in the illustrative embodiments and that other arrangements may be devised without departing from the spirit and scope of the present invention as defined by the appended claims.

What is claimed is:

1. An adjustable orifice assembly for use in an apparatus for homogenizing a pair of fluid components within a conduit, at least one of said components comprising a hydrocarbon fuel, said orifice assembly comprising impeding means arranged within said conduit for impeding the flow of a stream of at least one of said components, said impeding means having an opening provided therein, a pair of orifice defining means movably positioned in opposed relationship within said opening for defining an orifice between their relative spaced positions through which said stream of one of said components flows, and controlling means having a portion thereof extending into said opening for controlling the relative spaced position of at least one of said orifice defining means within said opening such that the size of said orifice is adjustable for effecting the homogenization of said pair of components within said conduit, said at least one of said orifice defining means being removably attached to said portion of said controlling means extending into said opening, the removably attached said orifice defining means being accessible from outside said impeding means for its removal from attachment to said portion of said controlling means and for the replacement thereof within said opening while said portion of said controlling means remains extending into said opening.

2. The orifice assembly as set forth in claim 1 wherein said impeding means comprises a body having a pair of opposed radially extending threaded passageways communicating between said opening and the periphery of said body.

3. The orifice assembly as set forth in claim 2 wherein said controlling means comprises a radially extending rod having a threaded portion adapted to be adjustably received within the threaded portion of said passageway and having one end adapted to removably secure said orifice defining means thereto.

4. The orifice assembly as set forth in claim 3 further including a gasket positioned about the circumference of said rod and adapted to provide a sliding seal between said rod and said passageway.

5. The orifice assembly as set forth in claim 1 wherein said orifice defining means is provided with a T-shaped slot adapted for removably securing said orifice defining means to said controlling means.

6. The orifice assembly as set forth in claim 1 wherein said opening is provided by forming means removably secured within said impeding means for forming said opening to receive said orifice defining means therein.

7. The orifice assembly as set forth in claim 1 wherein said pair of orifice defining means are removably attached to said controlling means within said opening.

8. The orifice assembly as set forth in claim 7 further including a cover removably secured to said impeding means overlying said opening therein, said cover having an aperture arranged in alignment with said orifice defined between the relative spaced position of said orifice defining means, whereby said orifice defining means can be removed from attachment to said controlling means within said opening of said impeding means for replacement thereof upon removal of said cover.

9. The orifice assembly as set forth in claim 1 wherein said components comprise a liquid component and a substantially insoluble component.

10. The orifice assembly as set forth in claim 1 wherein said components comprise two liquid components having different specific gravities.

11. The orifice assembly as set forth in claim 1 wherein said pair of orifice defining means are arranged along the longitudinal axis of said opening.

12. The orifice assembly as set forth in claim 1 further including means for feeding one of said components into a stream of the other of said components at a location downstream of said orifice defining means.

13. The orifice assembly as set forth in claim 1 further including means for feeding one of said components into a stream of the other of said components at a location upstream of said orifice defining means.

14. The orifice assembly as set forth in claim 1 further including access means arranged within said impeding means overlying said opening for permitting access to said orifice defining means within said opening from outside said impeding means.

15. An adjustable orifice assembly for use in an apparatus for homogenizing a pair of fluid components, at least one of said components comprising a hydrocarbon fuel, said orifice assembly comprising a body positioned within a stream of at least one of said components for impeding the flow thereof, said body having an opening and a pair of opposed radially extending passageways in communication with said opening, a pair of control rods positioned within said passageways and having one end thereof extending into said opening opposing one another, a pair of elements removably attached to said one end of said rods and movably positioned in opposed relationship within said opening along the longitudinal axis thereof for defining an orifice between their relative spaced positions, whereby the size of said orifice is adjustable over an operative range for effecting the homogenization of said components by controlling the longitudinal movement of at least one of said rods within said passageways to effect the relative spaced position between said elements within said opening, and a cover removably secured to said body overlying said opening therein, said cover having an aperture arranged in alignment with said orifice defined between the relative spaced position of said elements, said elements being accessible from outside said body upon removal of said cover to permit their removal from attachment to said one end of said rods and to permit the replacement thereof within said opening while said one end of said rods remains extending into said opening.

16. The orifice assembly as set forth in claim 15 wherein said rod includes a threaded portion adapted to be adjustably received within a threaded portion of said passageway.

17. The orifice assembly as set forth in claim 15 wherein said elements have a T-shaped slot for removably securing said elements to said one end of said rods.

18. The orifice assembly as set forth in claim 15 wherein said opening is provided for forming means removably secured within said body for forming said opening to slidingly receive said elements therein in opposed relationship.

19. The orifice assembly as set forth in claim 15 wherein said components comprise a liquid component and a substantially insoluble component.

20. The orifice assembly as set forth in claim 15 wherein said components comprise two liquid components having different specific gravities.

21. The orifice assembly as set forth in claim 15 wherein said homogenized fluid components comprise a fuel for the burner of a boiler.

* * * * *